US008215805B2

(12) United States Patent
Cogliano et al.

(10) Patent No.: US 8,215,805 B2
(45) Date of Patent: Jul. 10, 2012

(54) HOT AIMABLE LAMP ASSEMBLY WITH MEMORY FOR ADJUSTABLE RECESSED LIGHT

(75) Inventors: Frank Cogliano, New Windsor, NY (US); Stanley Edward Mayer, Middletown, NY (US); Patrick Fuchs, Hyde Park, NY (US); Christopher William McQuillan, Marlton, NJ (US)

(73) Assignee: USAI, LLC, New Windsor, NY (US)

( * ) Notice: Subject to any disclaimer, the term of this patent is extended or adjusted under 35 U.S.C. 154(b) by 310 days.

(21) Appl. No.: 12/471,337

(22) Filed: May 22, 2009

(65) Prior Publication Data

US 2010/0149822 A1 Jun. 17, 2010

Related U.S. Application Data

(60) Provisional application No. 61/056,063, filed on May 26, 2008.

(51) Int. Cl.
*F21V 17/02* (2006.01)

(52) U.S. Cl. ..... 362/366; 362/364; 362/365

(58) Field of Classification Search ..... 362/145–148, 362/153, 153.1, 217.08, 217.09, 217.1, 217.11–217.17, 362/227, 239, 240, 249.1, 249.11, 269, 277, 362/282, 285, 287, 310, 364–366, 368, 370, 362/371, 372, 418, 427, 428
See application file for complete search history.

(56) References Cited

U.S. PATENT DOCUMENTS 3,974,371 A * 8/1976 Miles, Jr. ..... 362/341
4,623,956 A * 11/1986 Conti ..... 362/148
4,947,297 A * 8/1990 Druffel et al. ..... 362/147
5,291,381 A * 3/1994 Price ..... 362/366
5,803,585 A * 9/1998 Littman et al. ..... 362/147
7,311,422 B1 * 12/2007 Chen ..... 362/364
7,476,008 B2 * 1/2009 Kay ..... 362/364
7,559,677 B1 * 7/2009 Dupre ..... 362/287
7,654,705 B2 * 2/2010 Czech et al. ..... 362/364
2003/0081422 A1 5/2003 Ward

OTHER PUBLICATIONS

Focal Point online catalogue; id The Intelligent Downlight; Accent Pinhole with Lens.

Lucifer Lighting Company online catalogue; Round Adjustable Gear Driven; Product No. DL2GZ-W.

Lucifer Lighting Company online catalogue; Round Adjustable Downlight; Product No. DL2GZ.

Lighting Design Lab News, Winter/Spring 2003, p. 3; "Ceramic Metal Halide" by Shaun Darragh LC.

Cooper Lighting online catalogue; Iris Lighting Systems P5.

Cooper Lighting online catalogue; RSA Lighting; Accurus Trim ACT1885 5" Square Recessed Adjustable Fixture.

* cited by examiner

*Primary Examiner* — Hargobind S Sawhney
(74) *Attorney, Agent, or Firm* — St. Onge Steward Johnston & Reens LLC

(57) ABSTRACT

A recessed light fixture has vertical tilt and horizontal rotation adjustments recessed radially outwardly from a trim aperture defining ring for a cleaner aspect of the lamp aperture. A lamp holder is reachable through the trim aperture for manually returning the lamp holder from a tilted position to a vertical position and is releasable downward from the fixture for relamping in response to manual pulling force. A mechanical memory returns the lamp holder to the initial tilted position upon reinsertion of the lamp holder and release of the manual pulling force. The lamp fixture can be miniaturized to a size of about 2.5 inches in diameter and sized to fit in a ceiling cutout of about 3.5 inches in diameter.

10 Claims, 12 Drawing Sheets

DETAIL C

DETAIL D

DETAIL F

DETAIL G

HOT AIMABLE LAMP ASSEMBLY WITH MEMORY FOR ADJUSTABLE RECESSED LIGHT

This application claims priority to the filing date of provisional patent application No. 61/056,063 filed May 26, 2008

BACKGROUND OF THE INVENTION

1. Field of the Invention

This invention relates generally to the field of interior and architectural lighting and more specifically concerns a hot aimable lamp and trim assembly with tilt memory for adjustable recessed light fixtures.

2 . State of the Prior Art

Recessed lighting is widely used for residential and commercial applications. Recessed light fixtures are installed in hollow spaces concealed by architectural panels such as ceilings, walls or floors, with only an aperture and a surrounding ornamental trim visible from the outside. The recessed fixture normally has a concealed sheet metal housing connected to a source of electrical power. The metal housing prevents contact of the hot light source with nearby flammable material. The housing has an aperture aligned with a cutout in the architectural panel, and a decorative trim covers the edge of the cutout to give a finished look to the installation.

Architectural recessed light fixtures fall into three broad categories: down lights, which typically direct the light output straight down from a ceiling; wall wash lights, which graze an architectural surface with light; and adjustable accent lights which aim a directional light at an area or object not directly underlying the fixture, such as an artwork on display or a furniture grouping.

Adjustable accent lights include a mechanism for aiming the light beam after the fixture has been installed, preferably while the fixture is turned on so that the effect of the lighting adjustment is immediately evident. This capability is known as hot aiming and is desirable because it allows adjustment without having to touch the hot lamp element.

Adjustable accent lights have commonly used halogen light sources. Halogen lamps are incandescent lamps with a tungsten filament sealed in a compact transparent envelope filled with an inert gas, plus a small amount of halogen such as iodine or bromine. Halogen lamps are small and can be used effectively with compact light reflector or lens systems for architectural lighting.

A trend towards more energy efficient lighting has brought about growing interest in metal halide lamps for architectural lighting. Metal halide lamps produce light by means of an electric arc between tungsten electrodes housed inside a translucent or transparent fused quartz or fused alumina tube. Compared with halogen lamps, metal halide lamps have higher luminous efficacy because more output is visible light as opposed to heat, and they also produce a greater amount of light output per watt of electricity input. Metal halide lamps also have much longer life spans than halogen lamps. On the other hand, metal halide lamps require a warm up period as long as two to five minutes, and when turned off require a cooling period of five to ten minutes before the arc can be relit.

Until not long ago metal halide lamps were mainly used in industrial applications where their lower cost of operation through reduced energy consumption and infrequent relamping requirements outweighed the warm up and cooling period requirements. In such applications the lights are turned on and off infrequently, often only once a day at opening and closing time. However, recent improvements in metal halide lamps have alleviated their former disadvantages making them more suitable for architectural lighting applications.

Lamps in recessed fixtures require occasional replacement. In larger fixtures this can be accomplished by reaching through the aperture of the fixture to remove the spent element and installing a fresh one. In compact recessed fixtures the aperture is too small to allow such access and fixtures have been developed with lamp holder assemblies which can be partially or entirely extracted through the trim aperture for access to the lamp element. In compact adjustable accent lights this requires that the lamp aiming mechanism be brought from an inclined position to an upright vertical position because the tilted mechanism will not pass through the small aperture. To facilitate lamp replacement, mechanical tilt memories have been developed which automatically return the aiming mechanism to its initial tilted condition after the lamp holder assembly is replaced into the fixture housing.

Compact recessed lights, requiring small cutouts in the architectural panel and having small trim apertures, are desirable and esthetically attractive. Yet the design of compact adjustable accent lights is challenging because there is little room for the hot aiming and tilt memory mechanisms, and even more so for metal halide lamps because these lamps are relatively large compared to halogen lamps and take up more space in the lamp assembly.

An example of an adjustable hot aimable lamp assembly with memory is the "I.D." or "Intelligent Downlight" family of accent lights sold by Focal Point L.L.C. of Chicago, Ill., for use with halogen and ceramic metal halide (CMH) lamps. The lamp assembly in these lights can be partially pulled from its housing for relamping. A memory feature returns the lamp holder and reflector to its inclined position when the lamp assembly is pushed back into its housing. A hot aiming mechanism is operated by turning adjustment screws in a circular flange which encompasses the aperture under the trim plate of the fixture. A shortcoming is that the external trim plate must be removed for access to the aiming adjustment screws. Also, the I.D. family of fixtures requires a five inch diameter cutout in the ceiling or other architectural surface.

A need exists for smaller adjustable accent lights with hot aiming and memory features, requiring, for example, a cutout of only 3.5 inch diameter, and capable of accommodating metal halide light sources as well as halogen lamps.

SUMMARY OF THE INVENTION

This invention addresses the aforementioned need by providing an adjustable lamp assembly for installation in a recessed light housing. The adjustable lamp assembly has a trim collar for attachment to the recessed housing through a cutout hole in an architectural surface such as a ceiling, a gear ring releasably fixed in the trim collar, and a bearing ring rotatable on the gear ring such that the collar, gear ring and bearing ring together define an aperture of the adjustable lamp assembly. A lamp holder with a reflector is supported on the bearing ring for directing a beam of light through the aperture. The lamp holder is tiltable on the bearing ring through a continuous tilt arc between a vertical and an inclined position. A vertical tilt adjustment is provided for adjusting inclination of the lamp holder on the bearing ring and a horizontal rotation adjustment for turning the bearing ring with the lamp holder relative to the gear ring and the trim collar. Each adjustment has a corresponding set screw preferably recessed in an inner surface of the bearing ring and accessible through the aperture of the lamp assembly for adjustment with a hand tool such as a screwdriver.

Each set screw may be recessed in a corresponding bore in the bearing ring. For example, the bearing ring may have an annular inner surface partly defining the aperture and the set screws are recessed in corresponding bores open on the annular inner surface.

The adjustable lamp assembly may have a tilt bias spring for biasing the lamp holder towards a fully inclined or tilted position, and the vertical adjustment is operative against this bias for adjusting the lamp holder to an intermediate tilted position continuously selectable between the vertical position and the fully inclined position.

A finger hold is connected to the lamp holder and can be reached with a hand through the aperture for manually pulling down and returning the lamp holder to a vertical position from a preset tilted position. The gear ring is then releasable together with the bearing ring and the lamp holder from the trim collar in response to further manual pulling force on the finger hold. Preferably, a mechanical memory is provided for returning the lamp holder to the preset tilted position after the finger hold is released of the manual pulling force.

In a preferred embodiment the vertical tilt adjustment includes a pin linearly displaceable along a threaded drive shaft supported for rotation on the bearing ring, with a first set screw rotatable on the bearing ring and a coupling spring connecting the threaded drive shaft for rotation with the set screw. The horizontal rotation adjustment may include a drive gear journaled to the bearing ring and in mesh with the crown gear, and another set screw coupled for turning the drive gear along the crown gear thereby to turn the bearing ring relative to the gear ring. Each set screw may be installed in a corresponding bore in the bearing ring where each bore is inclined with an open end towards the trim collar to facilitate access into the bore with the screwdriver or equivalent hand tool.

In another aspect of this invention a compact hot aimable trim assembly is provided for use with a metal halide lamp in a recessed light fixture, comprising a trim collar with a trim plate for installation in a ceiling cutout, a lamp holder assembly supported on the trim collar, the lamp holder assembly including a metal halide lamp and a parabolic light reflector for directing a beam of light emitted by the lamp through a trim aperture; a vertical tilt adjustment for adjusting inclination of the lamp holder assembly relative to the trim collar and a horizontal rotation adjustment for turning the lamp holder assembly in the trim collar such that the beam of light can be selectively aimed through the aperture; the trim aperture and the parabolic reflector each having a diameter substantially not greater than 2.5 inches and the trim collar being sized to fit in a ceiling cutout not substantially greater than 3.5 inch diameter.

The lamp holder assembly is removable through the trim aperture from the trim collar responsive to manual pulling force on the lamp holder assembly.

The lamp holder assembly is spring biased to a preset tilted position continuously selectable between a vertical position and a fully inclined position and the lamp holder is returnable to the vertical position responsive to the manual pulling force. The compact hot aimable trim assembly preferably has a mechanical memory for returning the lamp holder to the preset tilted position upon release of the manual pulling force. A vertical tilt adjustment and a horizontal rotation adjustment each have adjustment setting elements interior to the trim aperture and are accessible for adjustment with a hand tool such as a screwdriver inserted into the trim aperture without separation of the trim face from the trim assembly in the ceiling cutout. Each adjustment has a corresponding setting element recessed in a ring assembly outside the trim aperture diameter such that the aperture as seen from an exterior side of the trim plate presents a clean interior appearance unobstructed by either setting element.

DETAILED DESCRIPTION OF THE PREFERRED EMBODIMENT

Figure 1:
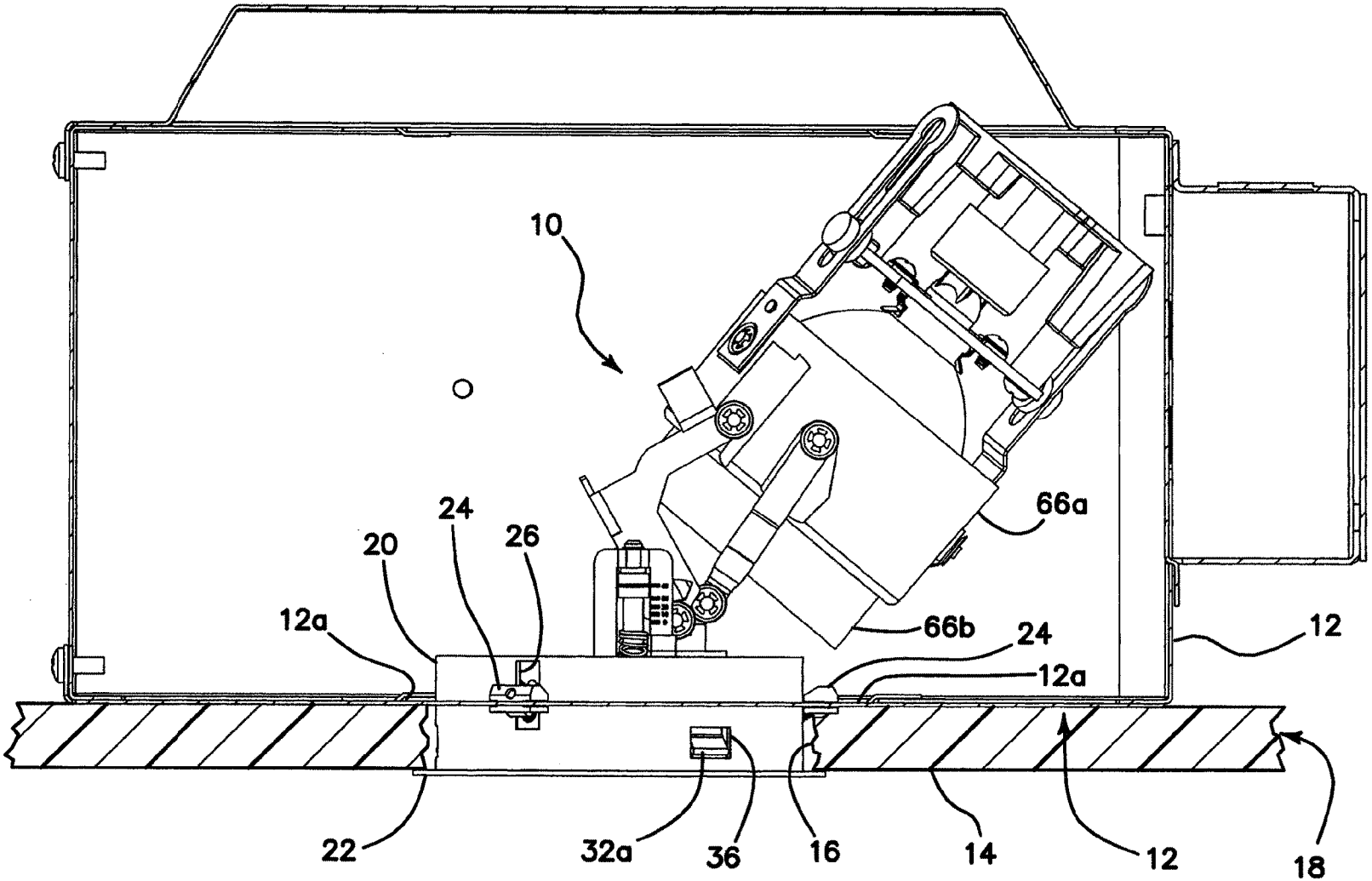
FIG. 1 is a side elevational view of the adjustable trim assembly shown installed in a typical recessed light housing.

With reference to the accompanying drawings in which like elements are designated by like numerals, FIG. 1 shows the hot aimable lamp and trim assembly with tilt memory of this invention generally designated by numeral 10. Trim assembly 10 is shown installed in a typical light housing 12 recessed above or behind an architectural panel 14. Housing 12 has a housing aperture defined by a rim 12*a* in register with a cutout opening 16 in panel 14.

A trim collar 20 fits through both the cutout 16 and the housing aperture, and is secured to rim 12*a* by three circumferentially spaced collar clamps 24. Collar clamps 24 are vertically adjustable on collar 20 in vertical slots 26 such that the clamps and the housing 12 can be raised or lowered on the collar as needed to compensate for differences in the thickness of panel 14 between trim face 22 and the housing bottom including rim 12*a*.

The trim collar 20 in the illustrated example is cylindrical in a circular cutout 16, but collar 20 and the cutout can be square, rectangular, oval, or any other shape.

The hot aimable lamp and trim assembly 10 will now be described with reference to FIGS. 1 through 10*c*. The assembly 10 includes a trim assembly supported on the trim collar 20 which defines the aperture of the recessed light, and a lamp assembly mounted on the trim assembly which can rotate horizontally and tilt vertically for aiming the light through the trim aperture. The trim assembly is in part stationary on the trim collar and in part rotatable with the adjustable lamp assembly. Hereafter, the stationary portion of the trim assembly is sometimes referred to as the base assembly.

Figure 2:
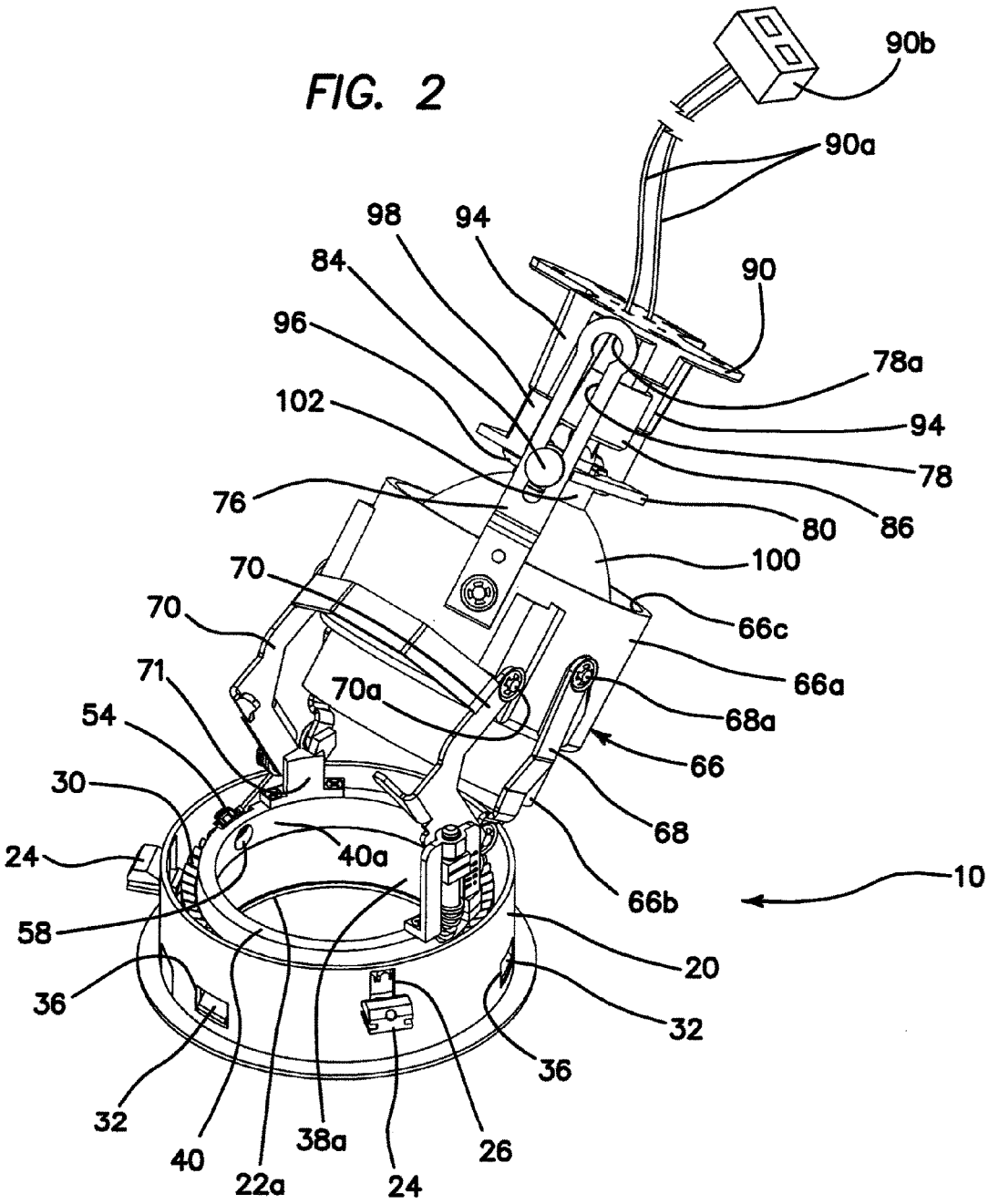
FIG. 2 is a perspective top side view of the adjustable trim assembly in a partially titled condition and free of light housing of FIG. 1.
Figure 3:
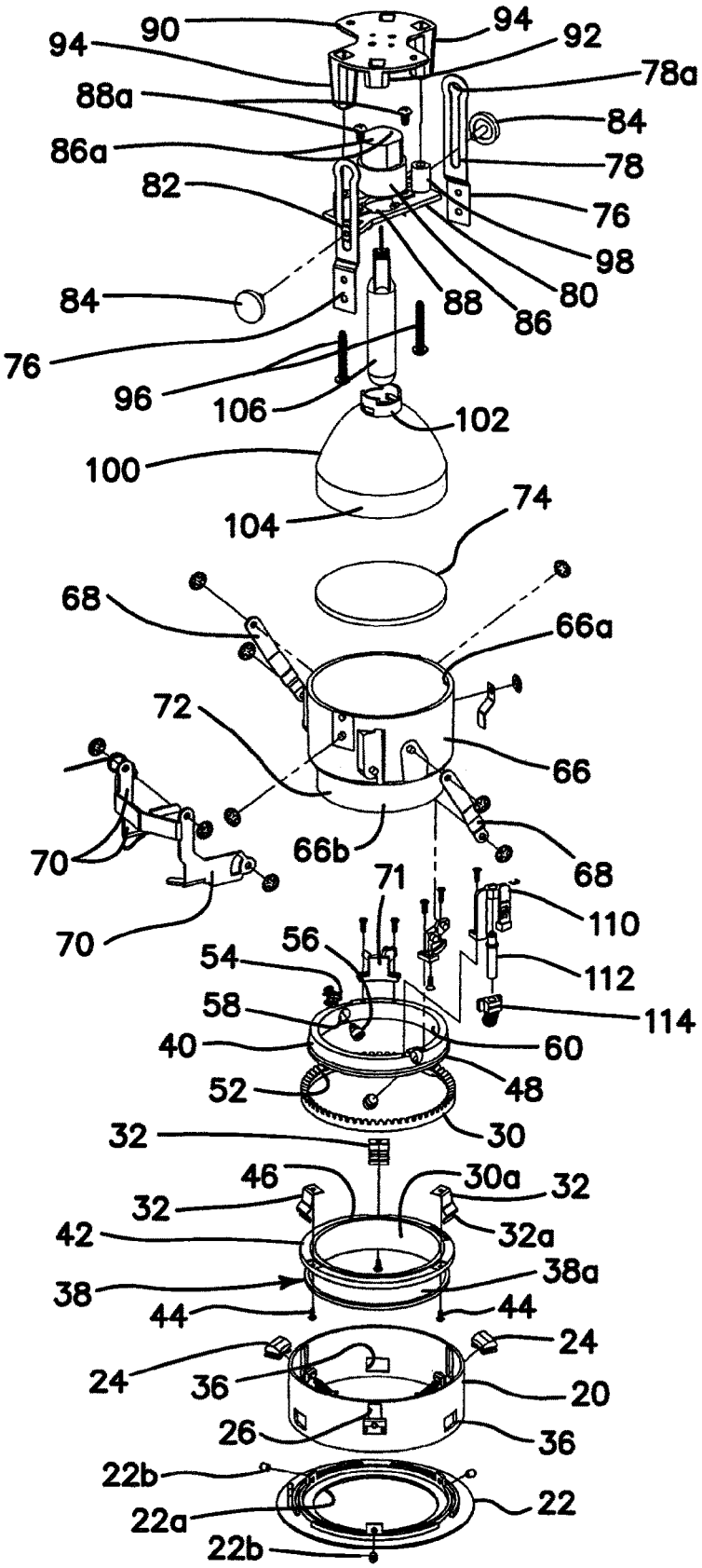
FIG. 3 is an axially exploded view of the adjustable trim assembly of FIGS. 1 and 2.
Figure 4:
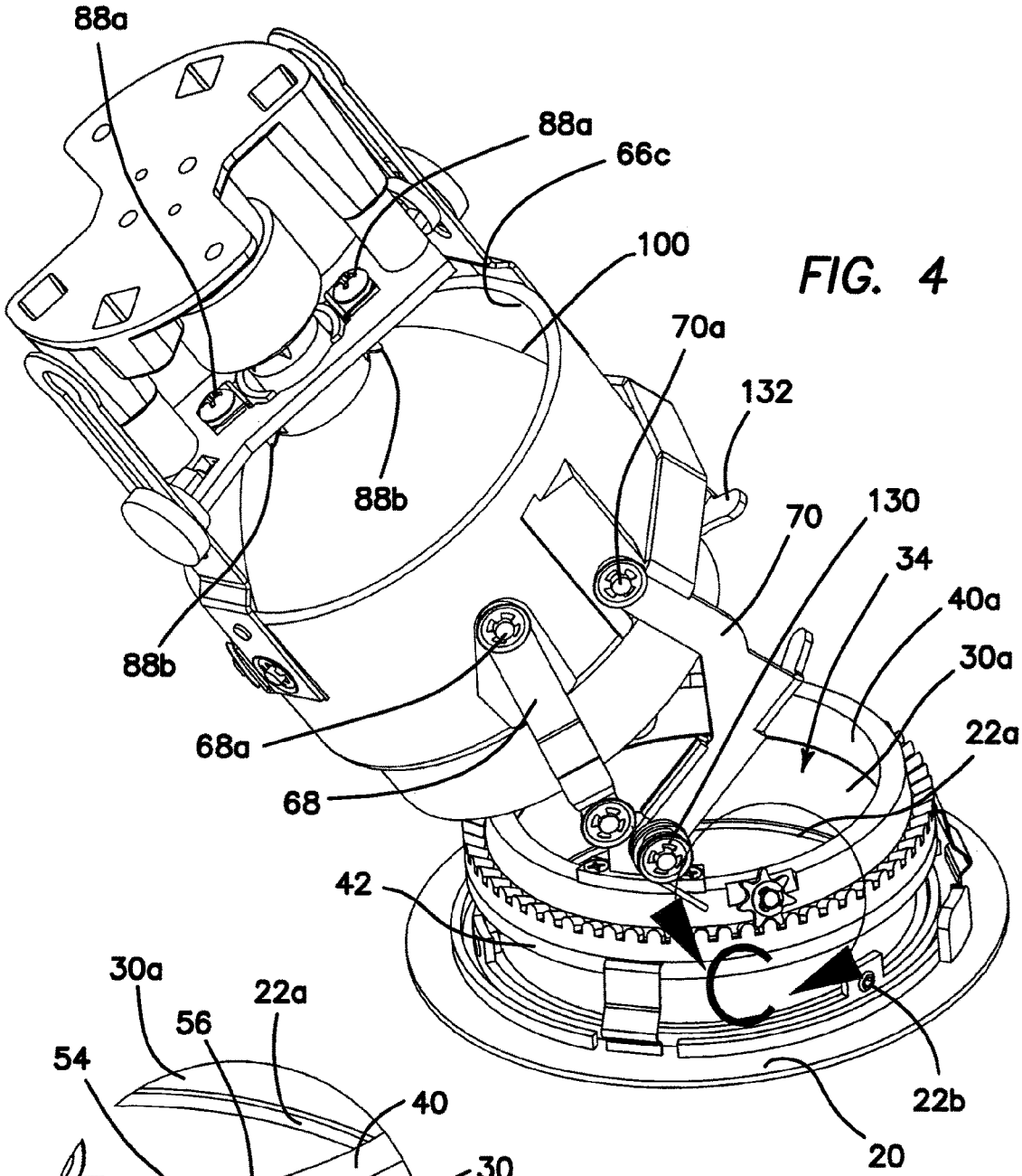
FIG. 4 is a top left perspective view of the trim assembly showing the torsion bias spring normally urging the assembly to a tilted position, and the horizontal drive pinion gear in mesh with the crown gear.
Figure 4A:
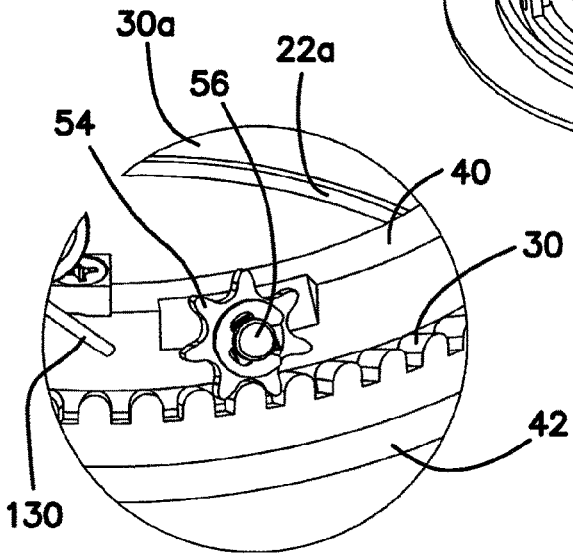
FIG. 4*a* is an enlarged detail view of area C in FIG. 4 showing the horizontal drive pinion gear.

Turning to FIGS. 2 and 3, the adjustable lamp assembly 10, shown free of the housing 12, has a crown gear 30 supported within trim collar 20 by three circumferentially spaced spring clips 32 which project radially from crown gear 30 and into corresponding spring windows 36 in collar 20. The stationary base assembly includes the crown gear 30, an insert 38 and a trim plate 22. Insert 38 has a cylindrical insert wall with an inner radial surface 38*a* and an external radial flange 42. Flange 42 is sized to pass through the inside of collar 20. Spring clips 32 are fastened to flange 42 at circumferentially spaced locations with screws 44 below flange 42 with outwardly curved spring portions 32*a* facing away from the cylindrical wall 38*a* of insert 38. Insert 42 can be pressed into the bottom of collar 20 such that the curved portions 32*a* of spring clips 32 are first flattened between collar 20 and insert 38, until trim plate 22 abuts against the bottom of collar 20 and spring clips reach alignment with windows 36, at which point the spring portions 32*a* are able to expand each into a corresponding window 36, thereby locking insert 38 and trim plate 22 against rotation relative to collar 20 and at the same time supporting insert 38 in collar 20 in a vertical or axial direction. Screws 44 pass through corresponding screw holes in insert flange 42, spring clips 32 and into threaded blind bores (not shown) in the underside of crown gear 30. The crown gear is consequently also fixed against rotation in collar 20 together with insert 38.

Crown gear 30 encompasses a circular bearing surface 46 on insert 38. A bearing ring 40 of outside diameter smaller than the inside diameter of crown gear 30 rests upon bearing surface 46. Ring 40 has a radial flange 48 which is captive in a sliding fit in a radial undercut 52 in gear 30, such that the flange 48 is axially captive but free to turn between crown gear 30 and insert 38, allowing bearing ring 40 to rotate relative to crown gear 30 and insert 38.

Insert 38 has an internal radial surface 38*a* and bearing ring 40 has an inner radial surface 40*a*. The inner radial surfaces 38*a* and 40*a* and trim plate opening 22*a* collectively define a trim aperture 34 of the lamp assembly 10. Preferably, trim plate opening 22*a* and inner radial surfaces 38*a* and 40*a* are all three of similar inside diameter such that the trim aperture 34, as seen through trim plate opening 22*a* in an installed condition of assembly 10 as in FIG. 1, has the appearance of a substantially continuous smooth cylindrical wall surface.

Figure 8A:
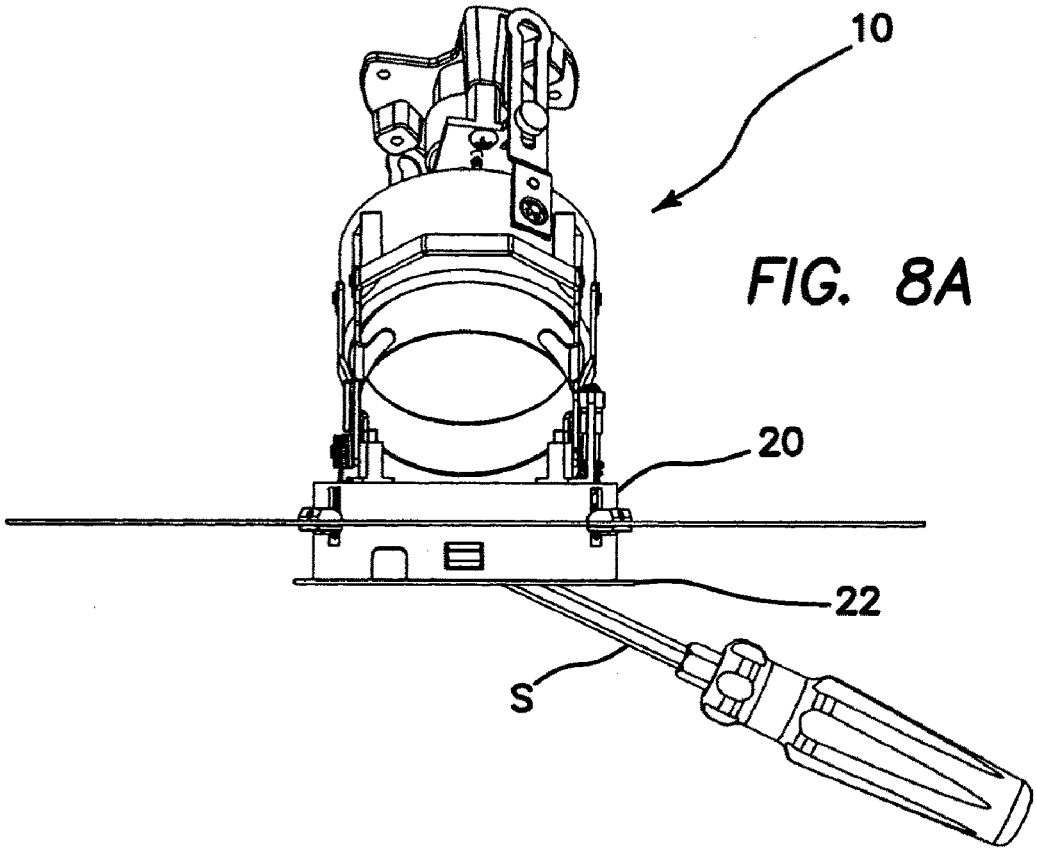
FIG. 8*a* is a front elevational view of the trim assembly in tilted position and illustrating how a screwdriver tool is inserted through the trim aperture for access to the horizontal rotation adjustment screw.
Figure 8B:
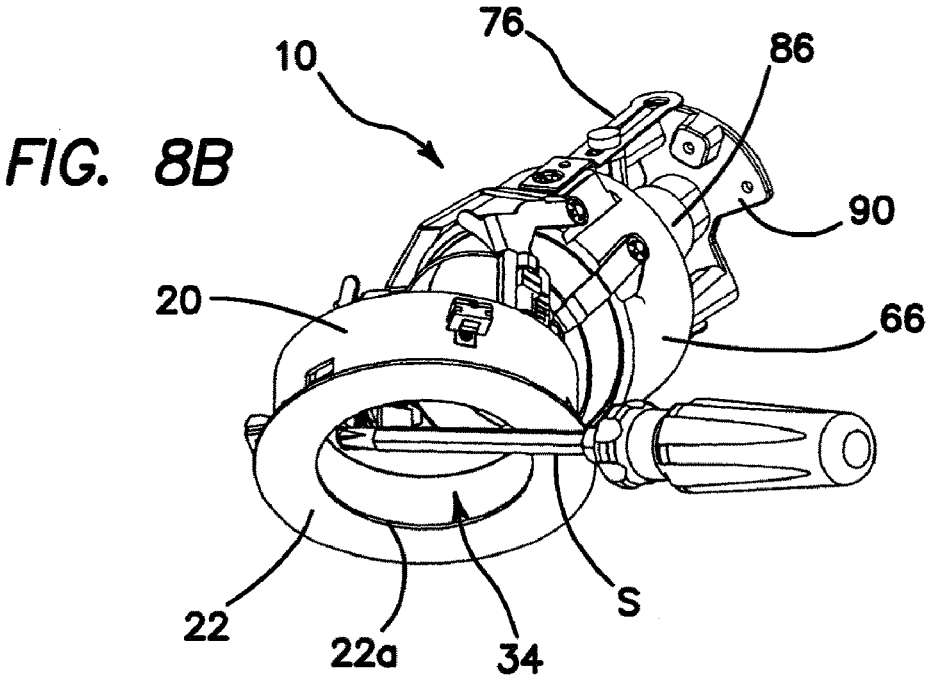
FIG. 8*b* is a bottom right side view of the mechanism tilted as in FIG. 8*a* and showing how the tip of the screwdriver tool reaches the horizontal rotation set screw recessed from the trim aperture.

Two set screws are installed for rotation in corresponding bores formed through bearing ring 40. A first set screw is horizontal adjustment screw 56 which turns in a first bore 58. Bore 58 opens on inner radial surface 40*a* of ring 40 and also opens on the radially outer surface of the bearing ring. The radially inner end of set screw 56 has a slotted screw head 56*a* which can be engaged with a suitable hand tool such as a screwdriver, as depicted in FIGS. 8A and 8B. The radially outer end of screw 56 carries a pinion gear 54 in mesh with crown gear 30. Turning of screw 56 also turns pinion gear 54 against the stationary crown gear 30, causing pinion gear 54 to travel around crown gear 30 carrying with it bearing ring 40 such that the latter turns on crown gear 30 and also in relation to insert 42 and collar 20.

Bearing ring 40 carries a tiltable lamp assembly which includes a lamp carrier 66 consisting of axially telescoped upper and lower cylindrical sleeves 66*a*, 66*b* open at opposite top and bottom ends. The lower sleeve 66*b* of lamp carrier 66 is of stepped-down inside diameter to define an interior radial step (not shown) on which can be supported any of a variety of light beam conditioning accessories used in the trade, for example, a circular light filter 74 shown in FIG. 3.

Figure 7A:
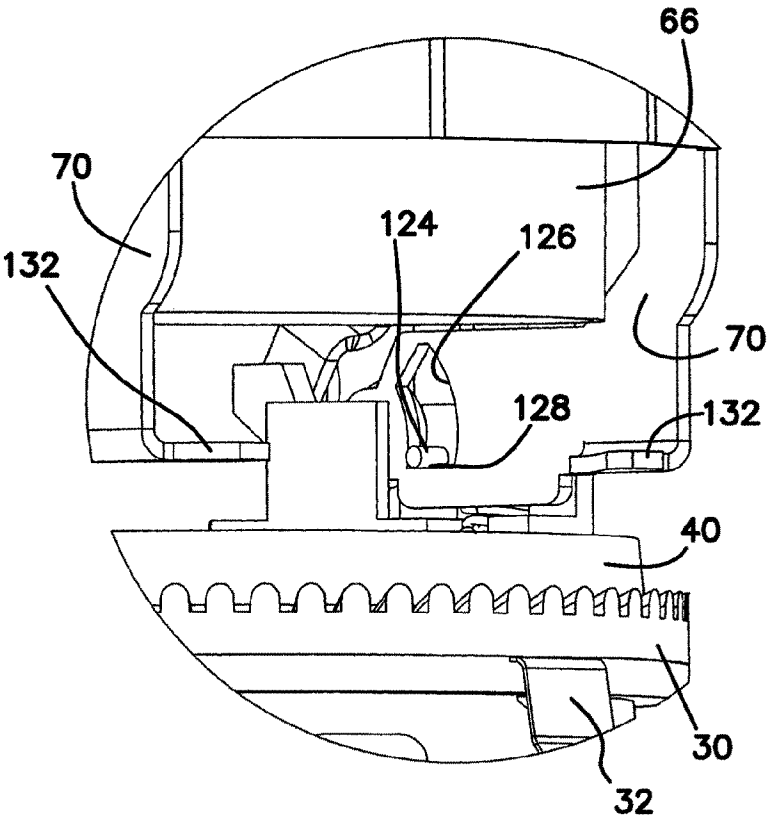
FIG. 7*a* is an enlarged detail view of area G in FIG. 7 showing how the stop pin abuts against the stop edge to hold the trim assembly in zero degree vertical position of FIG. 7.
Figure 7:
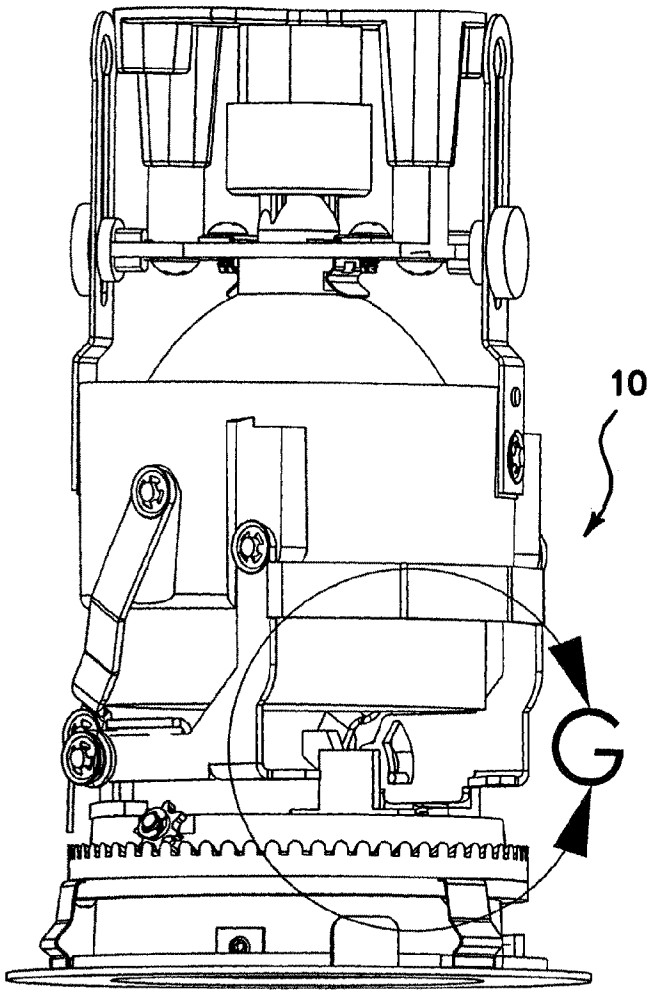
FIG. 7 is a front left elevational view of the trim assembly set in zero degree vertical position.

Carrier 66 is articulated to the bearing ring 40 by two pairs of linkage arms including two follower arms 68 and two actuating arms 70. Each arm 68, 70 has an upper end pivoted to carrier 66 at respective pins 68*a*, 70*a* and a lower end pivoted to corresponding posts 71 on bearing ring 40. Together, the four linkage arms permit carrier 66 to tilt through a continuous arc between a vertical position shown in FIGS. 7 and 7A where carrier 66 is axially aligned with bearing ring 40, crown gear 30 and insert 38, and a maximum inclined or tilted position shown in FIG. 4 which in the preferred embodiment is about 40 degrees from the vertical.

Two slide arms 76 are fastened to the top end of the carrier 66 on bosses 78 so that arms 76 are fixed at diametrically opposed points on the carrier 66 in mutually parallel relationship and also parallel to the center axis of carrier 66. Each arm 76 has a slot 78 terminating in an enlarged upper slot end 78*a*. A lamp carrier plate 80 has two integrally formed and internally threaded shaft heads 82 which extend each into a corresponding slot 78. The shaft heads have two flat sides which allow sliding movement along slot 78 but permit rotation of the shaft head 82 only at the enlarged slot ends 78*a*, when the carrier plate 80 is lifted away from carrier 66 to the top of slide arms 76. Thumb screws 84 are threaded into shaft heads 82 for keeping the shaft heads in slots 78. Carrier plate 80 carries a lamp socket or lamp holder 86 installed in an opening 88 in plate 80. A socket mounting plate 90 has a central connector 92 mated in electrical contact with corresponding connectors 86*a* provided in the top of lamp holder 86. A pair of electrical wires 90*a* extend from the top side of plate 90 to a quick-connect type connector 90*b* through which power is supplied to a lamp 106 installed in lamp holder 86. Mounting plate 90 also has two internally threaded and integrally formed spacers 94. Mounting plate 90 and carrier plate 80 are held together by screws 96 which pass through corresponding screw holes in carrier plate 80, then through tubular spacers 98 and into spacers 94, thereby capturing lamp holder 86 in electrical and mechanical assembly between plates 80 and 90.

A parabolic light reflector 100 has a centrally apertured reflector collar 102 configured to make twist lock engagement with a pair of retainer clips 88*b* held to carrier plate 80 by screws 88*a* and in axial alignment with the lower end of lamp holder 86, such that a lamp 106 can be inserted through collar 102 and fitted in corresponding electrical contacts provided in lamp holder 86.

Reflector 100 also has a cylindrical rim 104 which makes a sliding fit into top end 66*a* of carrier 66. In its normal operating position rim 104 is axially inserted into the open upper end 66*c* such that carrier 66 serves as a shroud for containing the light beam projected by lamp 106 and reflector 100 towards and through trim aperture 34.

Carrier 66 together with lamp holder 86 and reflector 100 is tiltable on linkage arms 68, 70 to an inclined position relative to the vertical center axis of trim collar 20, insert 38, crown gear 30 and bearing ring 40. A vertical tilt adjustment mechanism is provided for this purpose.

Figure 5:
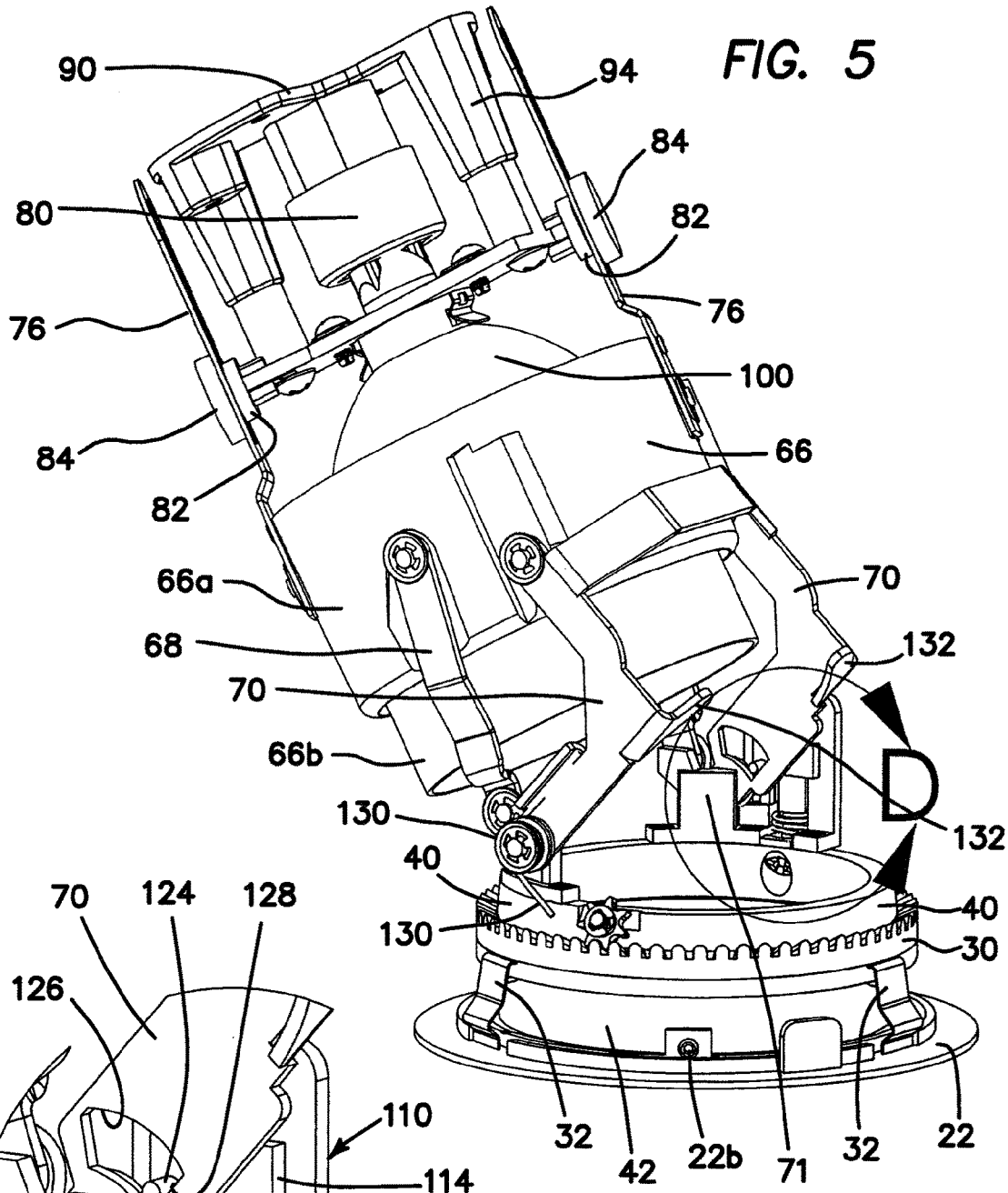
FIG. 5 is a front left perspective view of the trim assembly shown in a 30-degree tilt.
Figure 5A:
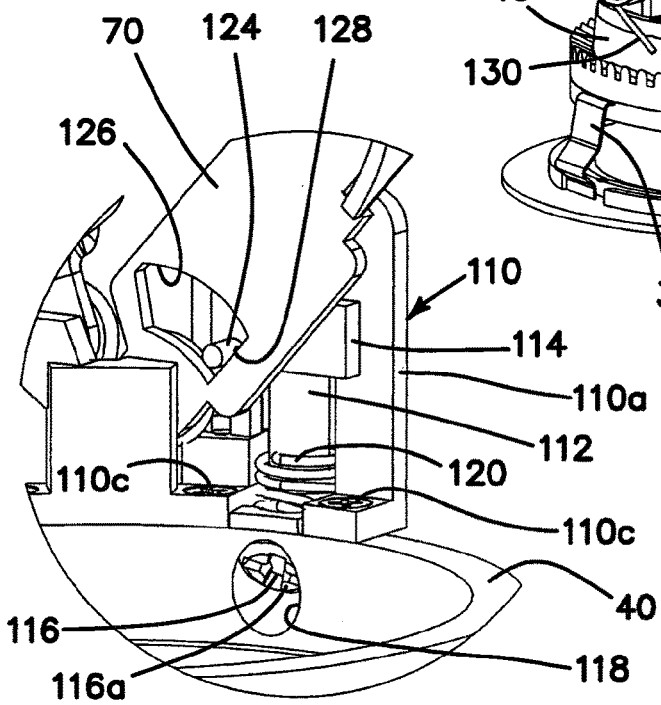
FIG. 5*a* is a detail view of area D in FIG. 5 showing the stop pin in abutment with the stop edge for setting the tilt of the trim assembly, and also illustrating the vertical tilt set screw recessed in its inclined bore in the bearing ring.
Figures 6, 6A:
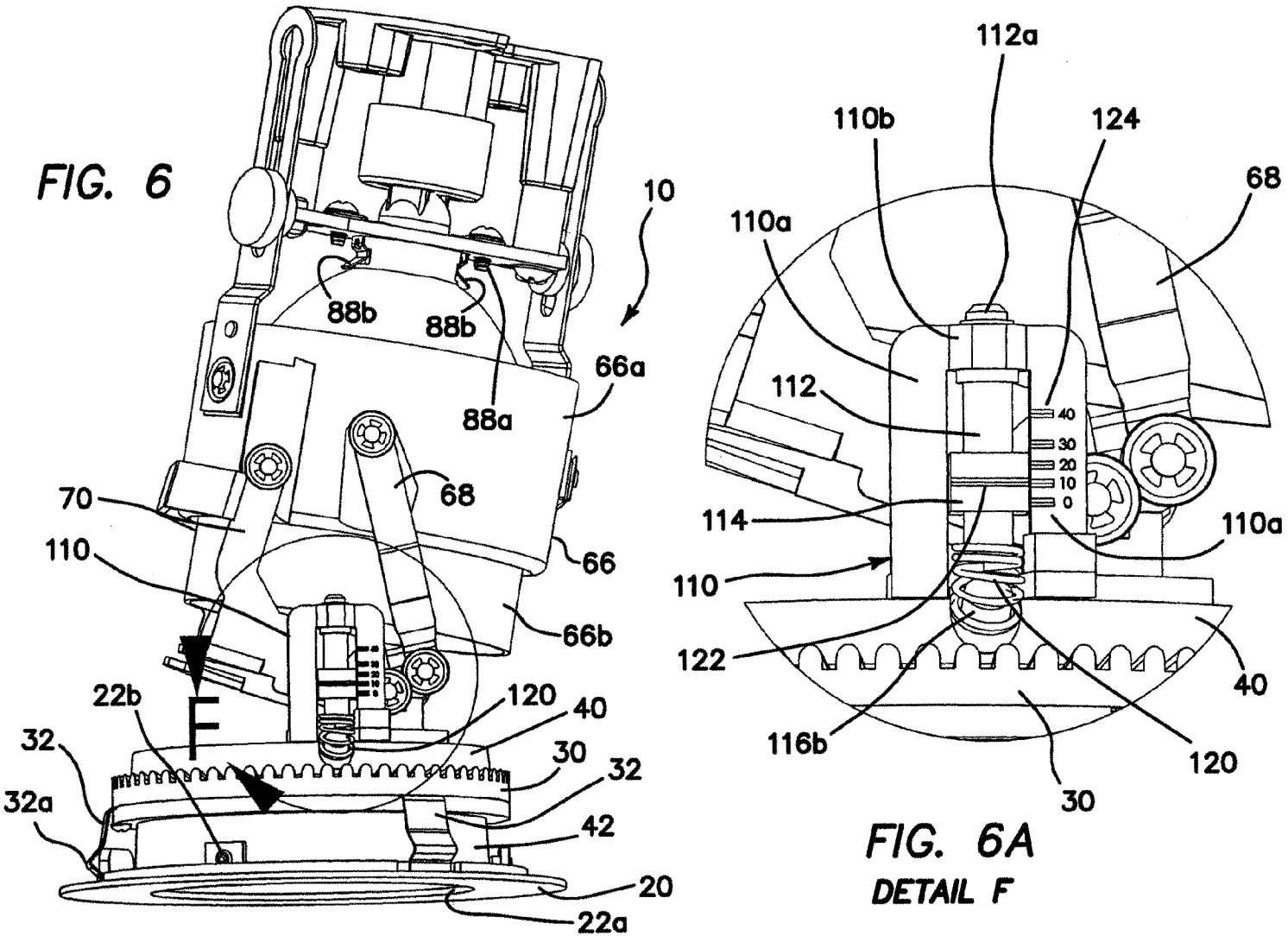
FIG. 6 is a right side elevational view of the trim assembly set to a ten-degree tilt.
FIG. 6*a* is an enlarged detail view of area F in FIG. 6 showing the outer side of the vertical tilt adjustment mechanism.

The vertical tilt adjustment includes an inverted U support frame 110, best seen in FIG. 6*a*, with two parallel upright legs 110*a* and a cross member 110*b*. The lower ends of legs 110*a* are fastened to bearing ring 40, as best seen in FIG. 5*a*, by screws 110*c*. A vertical threaded shaft 112 has an upper end 112*a* axially captive in a bore through cross member 110*b* but is free to turn relative to frame 110. A pin block 114 has an internally threaded bore mated to the shaft 112. Pin block 114 is captive between legs 110*a* of frame 110 such that it cannot turn about the shaft 112 but is free to move longitudinally along shaft 112 in response to rotation of shaft 112.

Figure 9A:
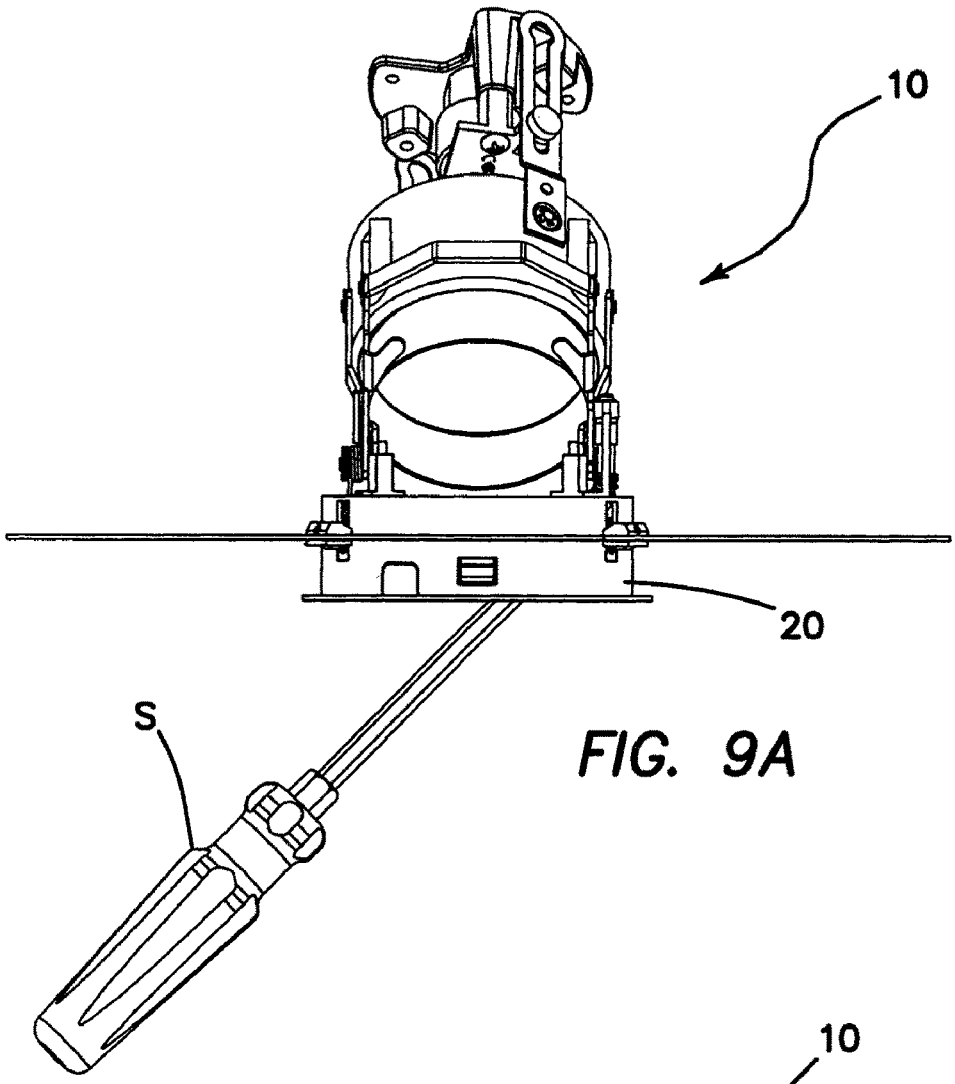
FIG. 9*a* is a front elevational view of the trim assembly in titled condition illustrating how a screwdriver tool is inserted into the trim aperture for access to the vertical tilt set screw.
Figure 9B:
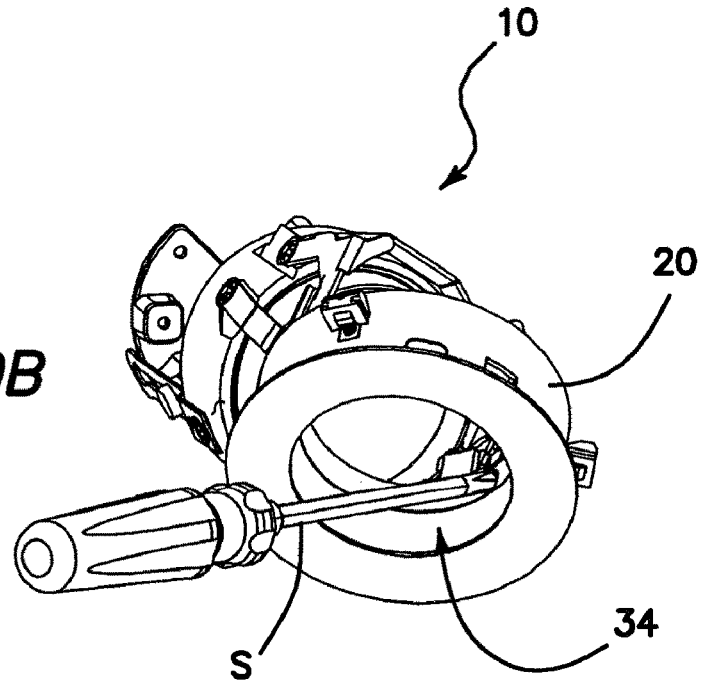
FIG. 9*b* is a bottom left view of the trim assembly tilted as in FIG. 9*a* and showing how the tip of screwdriver tool engages the vertical tilt set screw recessed from the trim aperture.
Figure 10A:
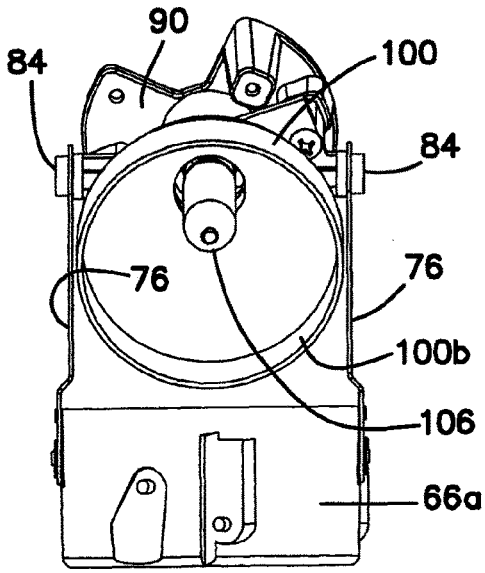
FIGS. 10*a*, 10*b* and 10*c* show the sub-assembly of the lamp holder/reflector supported on parallel sliding arms mounted on the carrier sleeve, the latter showing its integral pivot pins to which are normally connected the upper ends of the four linkage arms in the previous figures, FIG. 10*a* being a front elevational view of the sub-assembly, FIG. 10*b* being a side elevational view of the same and FIG. 10*c* being a front left perspective view of the same sub-assembly.
Figure 10B:
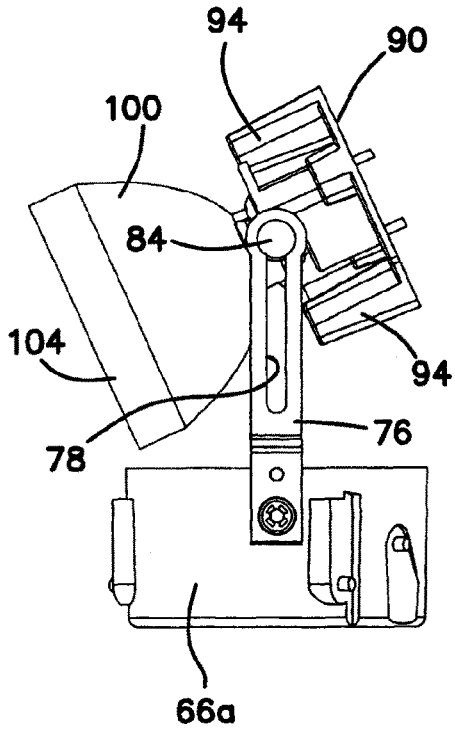
Figure 10C:
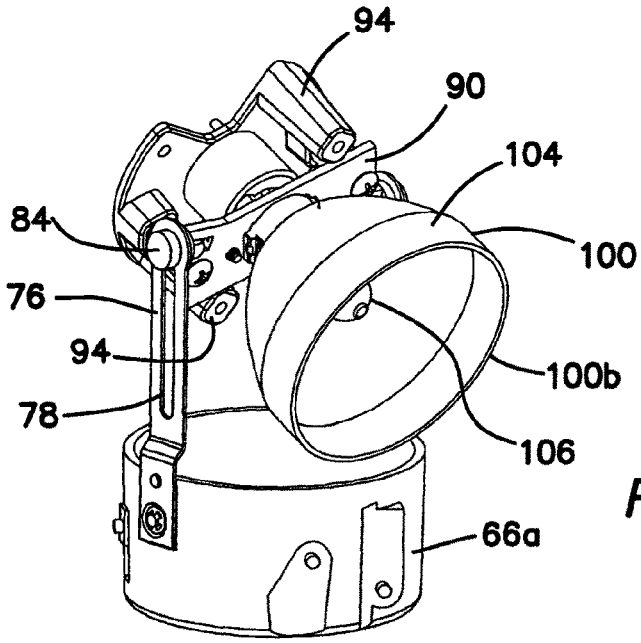
Figure 11:
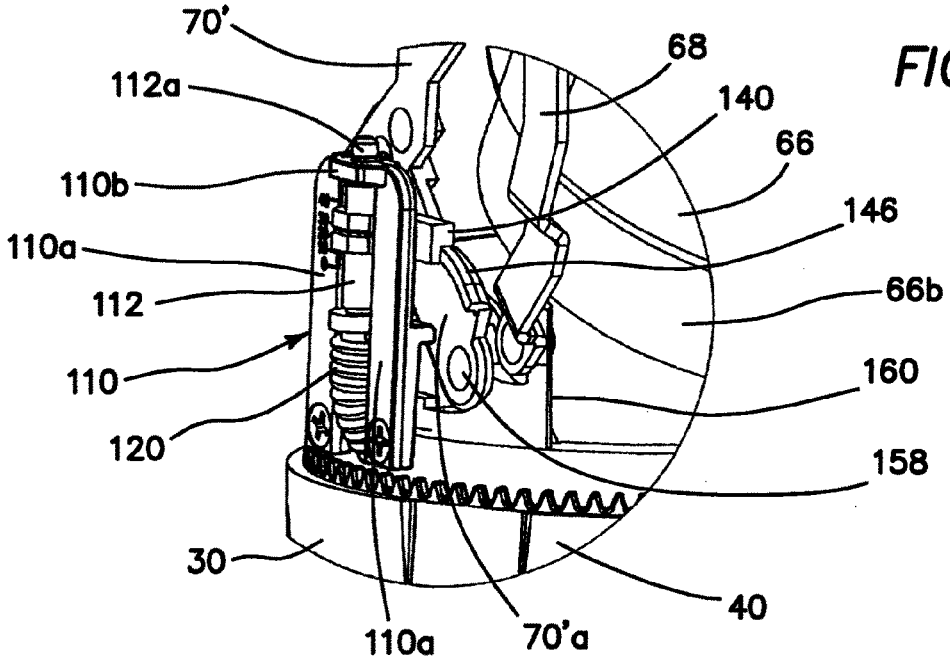
FIG. 11 is a detail left rear perspective view showing an alternate tilt adjustment mechanism of the adjustable lamp assembly.
Figure 14:
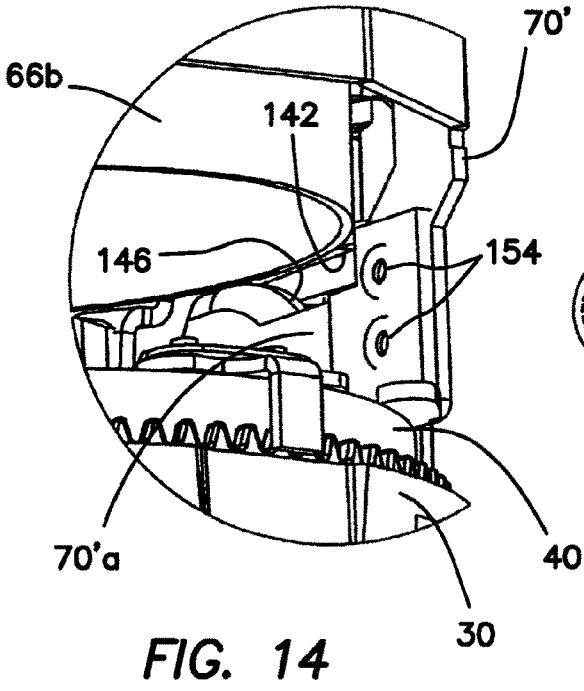
FIG. 14 shows the cam block and cam arm in fully depressed position corresponding to a vertical position of the lamp assembly.
Figure 14A:
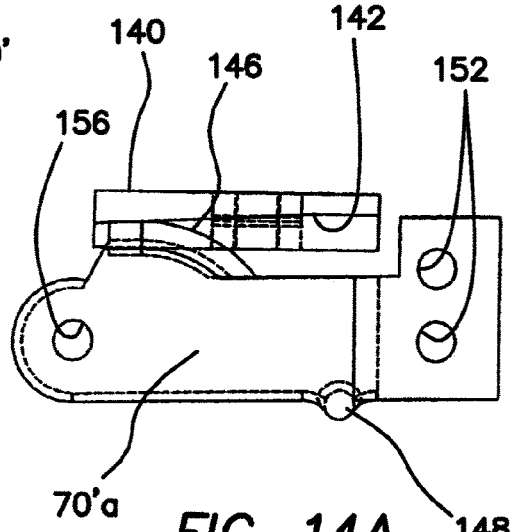
FIG. 14A schematically illustrates the relationship of the cam block and cam arm corresponding to the lamp assembly position of FIG. 14.

A vertical adjustment set screw 116 is set in a second bore 118 formed through bearing ring 40, as seen in FIG. 5*a*. Set screw 116 has a slotted screw head 116*a* recessed in the radially inner end of bore 118. Screw head 116*a* can be accessed with a suitable hand tool such as a screw driver inserted through trim aperture 34, as depicted in FIGS. 9A and 9B. The opposite end 116*b* of screw 116, on the radially outer side of ring 40, is coupled to the lower end of threaded shaft 112 by a flexible coupling coil spring 120, as shown in FIG. 6*a*. The axis of screw 116 may be inclined as shown relative to the center axis of ring 40 such that the slotted head 116*a* of the set screw faces downwardly towards the trim plate opening 22*a*, and the opposite end 116*b* extends outwardly and upwardly from the outer side of ring 40. The coupling spring 120 is bent along its longitudinal axis between the inclined set screw 116 and the lower end of vertical shaft 112 such that rotation of set screw 116 is transmitted by coil spring 120 for turning shaft 112, thereby linearly displacing block 114 up or down along shaft 112 depending on the direction of rotation of set screw 116 and shaft 112. A reference mark 122 on pin block 114 lines up to markings along a graduated scale 124 on one leg 110*a* to indicate the current tilt angle of the lamp holder and reflector assembly relative to the vertical axis of the base assembly.

A stop pin 124 projects radially inwardly from pin block 114 into a slot aperture 126 formed in the adjacent actuating arm 70, as best seen in FIG. 5*a*. Stop pin 124 is in interference with a stop edge 128 of slot 126. A torsion spring 130, seen in FIG. 5, is captive in compression between the other actuating arm 70 and bearing ring 40 and applies a continuous spring biasing force urging arm 70 and carrier 66, together with lamp holder 86 and reflector 100, towards a maximum tilted position determined only by the geometry of the mechanism but of at least 40 degree tilt from the vertical in the preferred embodiment. The action of bias spring 130 is limited by abutment of stop edge 128 against stop pin 124. The tilt angle at which this detent action occurs is continuously adjustable within the range of movement of stop pin 124 along threaded shaft 112. Raising pin 124 along shaft 112 allows stop edge 128 to travel further along its arc of movement towards a maximum titled position before abutting against pin 124, thereby increasing the tilt of the lamp assembly. Lowering pin 124 along shaft 112 has the opposite effect, forcing stop edge 128 downwardly and thereby forcing arm 70 to pivot downwardly thus bringing carrier 66 and the lamp/reflector assembly to a more fully upright, and eventually, vertical position on bearing ring 40.

Each actuating arm 70 has a finger hold 132 accessible through trim aperture 34 from the exterior side of trim plate 22, i.e. from the exterior side of the architectural panel 14 in FIG. 1. The finger tips of an extended hand can reach into aperture 34 and curl over finger holds 132 to pull finger holds 132 down towards the bearing ring 40, thereby overcoming the bias of torsion spring 30 and returning the lamp assembly to an upright, vertical position. Once upright, further downward pulling force overcomes the outward spring force of spring clips 32, forcing the clips radially inwardly into trim collar 20 and out of spring windows 36, thereby axially releasing the insert 38 from collar 20 and allowing the entire trim and lamp assembly supported on insert 38 to be pulled down and extracted from recessed housing 12 through trim collar 20 to the exterior side of architectural panel 14. Once so extracted from its housing, reflector 100 with lamp holder 86 can be lifted from carrier 66 by sliding the carrier plate 88 along slide arms 76 until shaft heads 82 reach the enlarged upper ends 78*a* of slot 78 where the shaft heads 82 can now rotate to tilt the plate 88 and swing parabolic reflector 100 from its normal downward facing position to a side facing condition, shown in FIGS. 10, *a*, 10*b* and 10*c*, with the open end 100*b* of reflector 100 presenting lamp 106 for easy removal and replacement. This same condition of the assembly 10 allows access to the interior of carrier 66 through open top end 66*a* for installation, removal or replacement of accessories such as the filter 74 shown in FIG. 3.

The stop pin 124, stop edge 128 and torsion spring 130 jointly operate also as a tilt memory mechanism for the lamp assembly 10 by allowing the lamp assembly to be manually pulled to an upright vertical position on the base assembly against the bias of spring 130 for extraction from the recessed housing 12, as explained above, yet with the bias force of spring 130 returning the lamp/reflector assembly to the same tilted position which existed before this manual uprighting of the assembly as determined by the position of stop pin 124, once the lamp assembly is released from the pulling force keeping it upright.

With reference to FIGS. 11-14A, an alternate embodiment of the vertical or tilt adjustment mechanism is shown. In the alternate embodiment the stop pin 124 and slot 126 of FIG.

5A is replaced with opposing cam surfaces as the first stop and second stop in lieu of the stop pin 124 and stop edge 128 of FIG. 5A.

A cam block 140 is threaded on the vertical screw 112 which is supported in frame 110, as previously explained in connection with FIG. 6*a*. The cam block 140 has a lip projecting away from screw 112 and towards linkage arms 68', 70', and which defines an undersurface 142. Linkage arm 70' includes a cam arm 70'*a* which carries a cam surface 146 and also carries a cam pin 148. The cam arm 70'*a* may be formed as a casting integrally with cam surface 146 and cam pin 148. Cam arm 70'*a* has a pair of fastener holes 152 through which pass fasteners such as rivets 154 seen in FIG. 12 to rigidly fasten cam arm 70'*a* to linkage arm 70'. A hole 156 admits a fastener 158 which anchors the arm section to a post 160 fixed to bearing ring 40. Fastener 158 also serves as a pivot for cam arm 70'*a*, allowing the cam arm to swing between a maximally elevated position shown in FIGS. 12, 12A and a fully depressed position seen in FIGS. 14, 14A.

Figure 12:
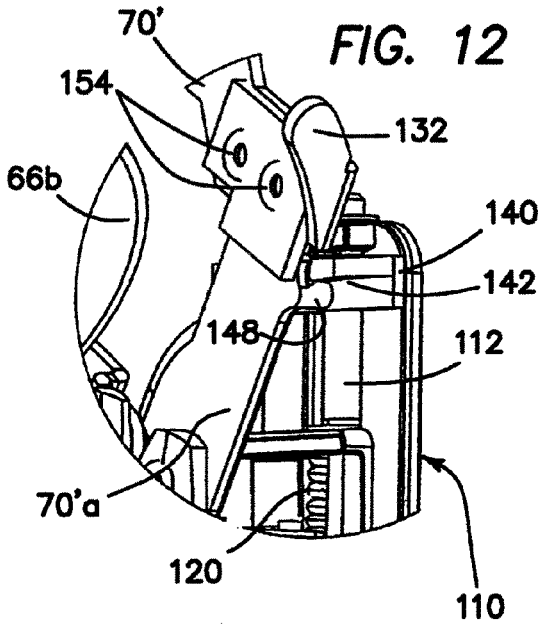
FIG. 12 is a detail front perspective view showing the alternate tilt adjustment mechanism of FIG. 11.
Figure 12A:
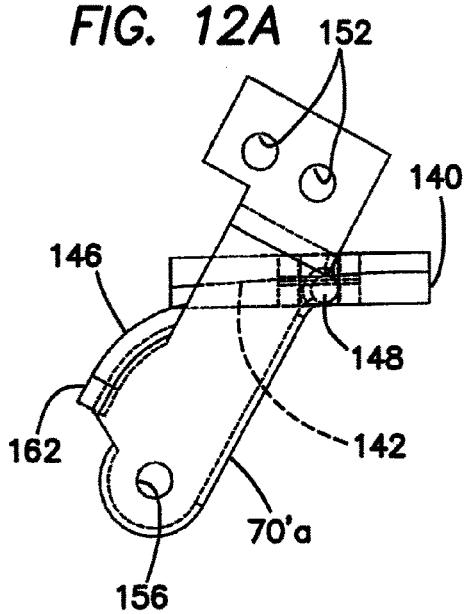
FIG. 12A is a schematic illustration of the cam block in relation to the cam arm at a maximally elevated position of the cam block corresponding to a fully tilted position of the lamp carrier.
Figure 13:
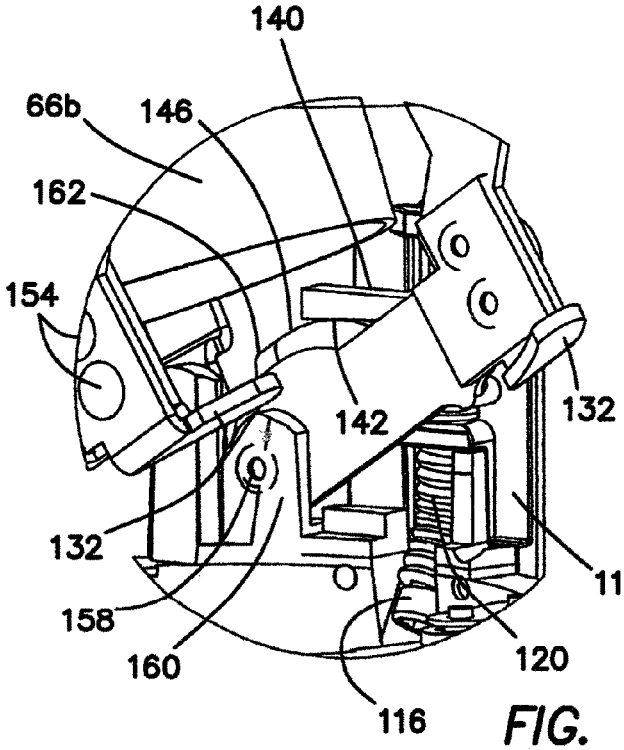
FIG. 13 is a view as in FIG. 12 with the cam block at an intermediate elevation on the threaded shaft, depressing the cam arm to an intermediate tilt position of the lamp assembly.
Figure 13A:
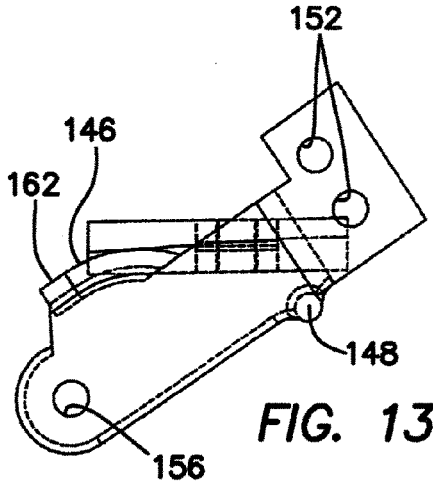
FIG. 13A shows the relationship between the cam block and cam arm corresponding to the tilt adjustment of FIG. 13.

FIGS. 12 and 12A show the cam arm 70'*a* and the cam block 140 in their maximally elevated position, corresponding to the cam block 140 being located at the upper end of the thread on threaded shaft 112, and to a maximally tilted position of the lamp carrier assembly. In this condition the undersurface 142 of cam block 140 is in contact with cam pin 148 but is spaced above and away from the cam surface 146 of cam arm 70'*a*. Rotation of threaded shaft 112 operates to move cam block 140 downwardly towards bearing ring 40, to an intermediate position illustrated in FIGS. 13, 13A, pushing down on cam pin 148 and depressing the cam arm 70'*a*. As undersurface 142 moves down further it engages the upper edge of cam surface 146 causing arm 70'*a* to pivot downwardly such that cam pin 148 moves away from the undersurface 142 of cam block 140, as seen in FIG. 13A. As cam block 140 is driven still further down along threaded shaft 112, the point of contact between undersurface 142 and the curved cam surface 146 travels from right to left in FIG. 13A to reach a condition illustrated in FIG. 14A, which corresponds to the cam block 142 being positioned at the lowermost end of the thread on shaft 112 and to a fully depressed condition of cam arm 70'*a* which consequently pulls down on linkage arm 70' to bring the lamp carrier assembly to a vertical position relative to the stationary base, i.e, the bearing ring 40, crown gear 30 and insert 42. The curved cam surface 146 ends in a flat end surface 162 for better contact with undersurface 142 in a fully upright position of the lamp carrier assembly. The curved cam surface 145 may have a circular radius of curvature, while other curvatures may yield different rates of arcuate motion of the lamp carrier assembly between its tilted and upright vertical positions. It has been found advantageous to provide a slope of between 3-6 degrees to the undersurface 142 rising from left to right in FIG. 14A for smoother camming action against cam surface 146.

In a preferred embodiment of the fixture, the lamp carrier assembly tilts to a maximum of 40 degrees, and the cam arm 70'*a* is configured such that cam block 140 operates against cam pin 148 as the lamp carrier assembly travels from the 40 degree tilt through about 32 degrees tilt, after which the cam block undersurface 142 comes into contact with cam surface 146 as the lamp carrier assembly travels from about 30 degree tilt through 0 degree or full vertical position, at which point the cam block 140 pushes down against the flat portion 162 of the cam surface.

A presently preferred embodiment of the invention has been described and illustrated for purposes of clarity and example only, and it will be apparent to those having ordinary skill in the art that many changes, substitutions and modifications can be made to this embodiment without thereby departing from the scope and spirit of the invention.

What is claimed is:

1. An adjustable lamp assembly insertable within an aperture of a recessed light fixture, said adjustable lamp assembly comprising:

a base adapted to removably connect the lamp assembly to said recessed light fixture;

a lamp holder connected to said base by at least two linkage arms, each linkage arm being pivotally connected to said lamp holder and to said base;

said linkage arms being operable to allow adjustment of an angle of tilt of said lamp holder relative to said base between a vertical position, wherein said lamp holder is aligned substantially directly above said base, and a fully inclined position, wherein said lamp holder is substantially displaced from said vertical position;

a vertical-tilt adjustment mechanism operable to adjust said angle of tilt of said lamp holder relative to said base, said vertical-tilt adjustment mechanism having a cam movable relative to said base and said cam bearing on a cam surface fixed to one of said linkage arms;

said cam travels along a straight path;

said cam surface having a flat portion and a curved portion;

a cam pin being affixed to said one linkage arm; and said cam contacting said flat portion of said cam surface when said lamp holder is in said vertical position, said cam contacting said cam pin when said lamp holder is in said fully inclined position, and said cam contacting said curved portion of said cam surface when said lamp holder is intermediate said vertical position and said fully reclined position.

2. An adjustable lamp assembly as in claim 1, wherein:

said cam travels along a substantially vertical path; and said flat portion of said cam surface is inclined at an angle of about 3-6 degrees relative to horizontal.

3. An adjustable lamp assembly as in claim 1, wherein:

said lamp assembly has an illumination aperture which is substantially circular and which has a diameter of at least about 2.5 inches, and said adjustable lamp assembly is adapted to be received through a circular aperture of said recessed light fixture having a diameter of not more than about 3.5 inches.

4. An adjustable lamp assembly as in claim 1, wherein:

said lamp assembly has an illumination aperture;

said cam travels along a substantially vertical path;

said vertical-tilt adjustment mechanism is adjustable by rotation of a vertical-tilt adjustment screw accessible through said illumination aperture;

said vertical-tilt adjustment screw being inclined relative to said vertical path of said cam; and said vertical-tilt adjustment screw actuates said cam through a curved coil spring.

5. An adjustable lamp assembly as in claim 4, further comprising:

means to bias said lamp holder toward said fully inclined position; and said vertical-tilt adjustment mechanism is operable against said bias means.

6. An adjustable lamp assembly as in claim 5, further comprising:

a horizontal-rotation adjustment mechanism operable to adjust the rotational alignment of the lamp assembly relative to the base; and said horizontal-rotation adjustment mechanism is adjustable by rotation of a horizontal -rotation adjustment screw accessible through said illumination aperture.

7. An adjustable lamp assembly insertable within an aperture of a recessed light fixture, said adjustable lamp assembly comprising:

a base adapted to removably connect the lamp assembly to said recessed light fixture;

a lamp holder connected to said base by at least two linkage arms, each linkage arm being pivotally connected to said lamp holder and to said base;

said linkage arms being operable to allow adjustment of an angle of tilt of said lamp holder relative to said base between a vertical position, wherein said lamp holder is aligned substantially directly above said base, and a fully inclined position, wherein said lamp holder is substantially displaced from said vertical position;

a vertical-tilt adjustment mechanism operable to adjust said angle of tilt of said lamp holder relative to said base, said vertical-tilt adjustment mechanism having a cam movable relative to said base and said cam bearing on a cam surface fixed to one of said linkage arms; and said lamp assembly having an illumination aperture which is substantially circular and which has a diameter of at least about 2.5 inches, and said adjustable lamp assembly being adapted to be received through a circular aperture of said recessed light fixture having a diameter of not more than about 3.5 inches.

8. An adjustable lamp assembly as in claim 7, wherein:

said lamp assembly has an illumination aperture;

said cam travels along a substantially vertical path;

said vertical-tilt adjustment mechanism is adjustable by rotation of a vertical-tilt adjustment screw accessible through said illumination aperture;

said vertical-tilt adjustment screw being inclined relative to said vertical path of said cam; and said vertical-tilt adjustment screw actuates said cam through a curved coil spring.

9. An adjustable lamp assembly as in claim 8, further comprising:

means to bias said lamp holder toward said fully inclined position; and said vertical-tilt adjustment mechanism is operable against said bias means.

10. An adjustable lamp assembly insertable within an aperture of a recessed light fixture, said adjustable lamp assembly comprising:

a base adapted to removably connect the lamp assembly to said recessed light fixture;

a lamp holder connected to said base by at least two linkage arms, each linkage arm being pivotally connected to said lamp holder and to said base;

said linkage arms being operable to allow adjustment of an angle of tilt of said lamp holder relative to said base between a vertical position, wherein said lamp holder is aligned substantially directly above said base, and a fully inclined position, wherein said lamp holder is substantially displaced from said vertical position; and a vertical-tilt adjustment mechanism operable to adjust said angle of tilt of said lamp holder relative to said base, said vertical-tilt adjustment mechanism having a cam movable relative to said base and said cam bearing on a cam surface fixed to one of said linkage arms.

* * * * *